US011779129B2

(12) United States Patent
Zhao

(10) Patent No.: US 11,779,129 B2
(45) Date of Patent: Oct. 10, 2023

(54) GAME TABLE AND CHAIR FOR BABIES

(71) Applicant: Zhejiang Asweets Kids Product Co., Ltd., Shaoxing (CN)

(72) Inventor: Fujian Zhao, Shaoxing (CN)

(73) Assignee: ZHEJIANG ASWEETS KIDS PRODUCT CO., LTD., Zhejiang (CN)

( * ) Notice: Subject to any disclaimer, the term of this patent is extended or adjusted under 35 U.S.C. 154(b) by 0 days.

(21) Appl. No.: 17/789,565

(22) PCT Filed: Jun. 11, 2021

(86) PCT No.: PCT/CN2021/099624

§ 371 (c)(1),
(2) Date: Jun. 28, 2022

(87) PCT Pub. No.: WO2022/127052

PCT Pub. Date: Jun. 23, 2022

(65) Prior Publication Data

US 2023/0050953 A1 Feb. 16, 2023

(30) Foreign Application Priority Data

Dec. 15, 2020 (CN) ..... 202023018117.2

(51) Int. Cl.
*A47D 1/00* (2006.01)
*A47B 37/00* (2006.01)
*A47D 15/00* (2006.01)

(52) U.S. Cl.
CPC ..... *A47D 1/0085* (2017.05); *A47B 37/00* (2013.01); *A47D 15/006* (2013.01); *A47D 1/008* (2013.01)

(58) Field of Classification Search
CPC .. A47D 1/0085; A47D 1/0081; A47D 1/0083; A47D 1/008; A47D 15/006; A47B 37/00
See application file for complete search history.

(56) References Cited

U.S. PATENT DOCUMENTS 7,300,103 B1 * 11/2007 Grays ..... A47D 1/0085 297/188.1
10,314,409 B2 * 6/2019 Yu ..... A47D 1/00
(Continued)

FOREIGN PATENT DOCUMENTS

CN 2308297 Y 2/1999
CN 202354962 U 8/2012
(Continued)

*Primary Examiner* — Syed A Islam
(74) *Attorney, Agent, or Firm* — MUNCY, GEISSLER, OLDS & LOWE, P.C.

(57) ABSTRACT

The present utility model provides a game table and chair for babies, comprising a semi-closed seat with armrests and a backrest, wherein the front sides of the armrests are detachably connected with a table board; the outer side faces of the armrests are planes, and table top mounting belts are arranged on the outer side faces; the two sides of the table top mounting belts are connected with the armrests, and first mounting holes are formed between the middles of the table top mounting belts and the armrests; the side face of the table board is correspondingly connected with table top mounting strips; magic tapes and magic tape fasteners are arranged at the ends and belt bodies of the table top mounting strips respectively; the table top mounting strips penetrate through the first mounting holes, and the table top mounting strips and the seat are detachably connected together through the magic tapes and the magic tape fasteners; two backrest mounting belts are arranged on the front face of the backrest; the two sides of the backrest mounting belts are connected with the backrest; and second mounting holes are formed between the middles of the backrest mounting belts and the backrest. The present utility model is suitable for the intelligence development of babies and training of hands-on ability; and it is convenient for disassembly and assembly, convenient for babies to get on and off the chair, with a large activity space and high comfort.

5 Claims, 3 Drawing Sheets

(56) References Cited

U.S. PATENT DOCUMENTS

| | | | | |
|---|---|---|---|---|
| 11,166,570 | B1 * | 11/2021 | Flannery | A47D 1/023 |
| 11,284,727 | B2 * | 3/2022 | Bernardo | A47D 1/0085 |
| 11,503,906 | B1 * | 11/2022 | Okodogbe | A47D 1/0085 |
| 2005/0092212 | A1 * | 5/2005 | Simon | B60N 2/26 108/43 |
| 2007/0018490 | A1 | 1/2007 | Jones | |
| 2007/0029848 | A1 * | 2/2007 | Probst | B60N 2/28 297/148 |

FOREIGN PATENT DOCUMENTS

| | | | |
|---|---|---|---|
| CN | 207940537 | U | 10/2018 |
| CN | 211382476 | U | 9/2020 |

* cited by examiner

GAME TABLE AND CHAIR FOR BABIES

TECHNICAL FIELD

The present utility model relates to the technical field of child care supplies, and particularly relates to a game table and chair for babies.

BACKGROUND

Presently, most chairs for babies can only be used as dining chairs for babies' daily meals. However, babies learn to sit and stand at 6 months, and their physical development progresses every day. Baby's game table and chair can be used to train babies' coordination ability of hands, eyes and brain. The conventional game table and chair for babies cannot be disassembled or the seat has a surrounding wall after disassembly, which is inconvenient for the babies to get on and off the chairs, and the activity space is narrow, the comfort is not high.

SUMMARY

The object of the present utility model is to provide a game table and chair for babies. The present utility model is suitable for the intelligence development of babies and training of hands-on ability; and it is convenient for disassembly and assembly, convenient for babies to get on and off the chair, with a large activity space and high comfort.

In order to achieve the foregoing object, the present utility model adopts the following technical solutions:

A game table and chair for babies is characterized by comprising a semi-closed seat with armrests and a backrest, wherein the front sides of the armrests are detachably connected with a table board; the outer side faces of the armrests are planes, and table top mounting belts are arranged on the outer side faces; the two sides of the table top mounting belts are connected with the armrests, and first mounting holes are formed between the middles of the table top mounting belts and the armrests; the side face of the table board is correspondingly connected with table top mounting strips; magic tapes and magic tape fasteners are arranged at the ends and belt bodies of the table top mounting strips respectively; the table top mounting strips penetrate through the first mounting holes, and the table top mounting strips and the seat are detachably connected together through the magic tapes and the magic tape fasteners; two backrest mounting belts are arranged on the front face of the backrest; the two sides of the backrest mounting belts are connected with the backrest; and second mounting holes are formed between the middles of the backrest mounting belts and the backrest.

Further, the leaning face of the backrest is a rectangular plane, the armrests are arranged on the two sides of the backrest and are straight armrests, and the whole game table and chair for baby is in a semi-closed square shape.

Further, through grooves allowing feet of the baby to penetrate through are formed between the table board and a bottom plate of the seat and between the armrests on the two sides, and the through grooves are communicated with the outside.

Further, a handle is arranged on the upper surface of the backrest of the seat.

Further, the table top mounting belts are arranged on the armrests on the two sides of the seat, and the table top mounting strips are correspondingly connected to the two sides of the table board.

Compared with the prior art, the present utility model has the following beneficial effects:

The present utility model is suitable for the development of babies' intelligence and the cultivation of hands-on ability, and is easy to disassemble and assemble; when the table board is disassembled, babies can freely practice how to get up and down the chair, which is convenient for babies to learn to sit and stand; moreover, the structure is stable, the activity space is large, and the comfort is high; the present utility model is provided with a crotch cloth or a safety belt to ensure the correct sitting posture of babies, thereby protecting babies' undeveloped spine and safety.

Figure 1:
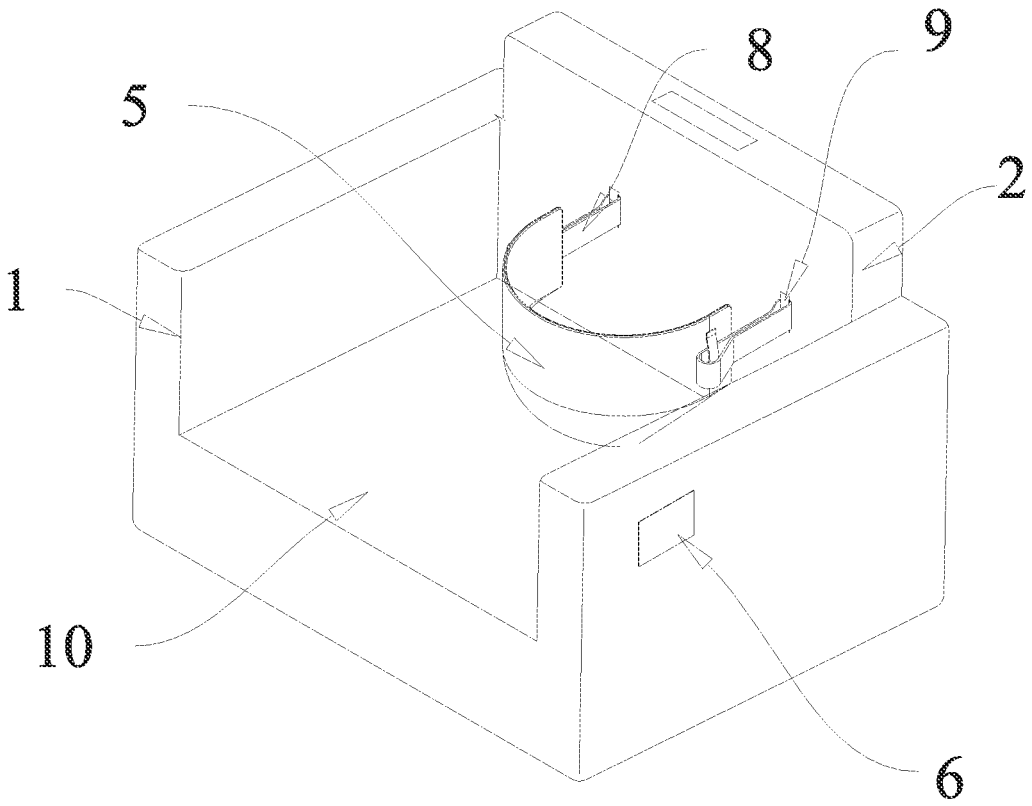
FIG. 1 is a structural representation of the present utility model.

Reference numerals: 1—armrest; 2—backrest; 3—seat; 4—table board; 5—crotch cloth; 6—table top mounting belt; 7—table top mounting strip; 8—waistband; 9—backrest mounting belt; 10—bottom plate; 11—through groove; 12—handle.

DETAILED DESCRIPTION

The present utility model will be further described in conjunction with accompanying drawings and embodiments, but these drawings and embodiments are not intended to limit the present utility model.

Figure 2:
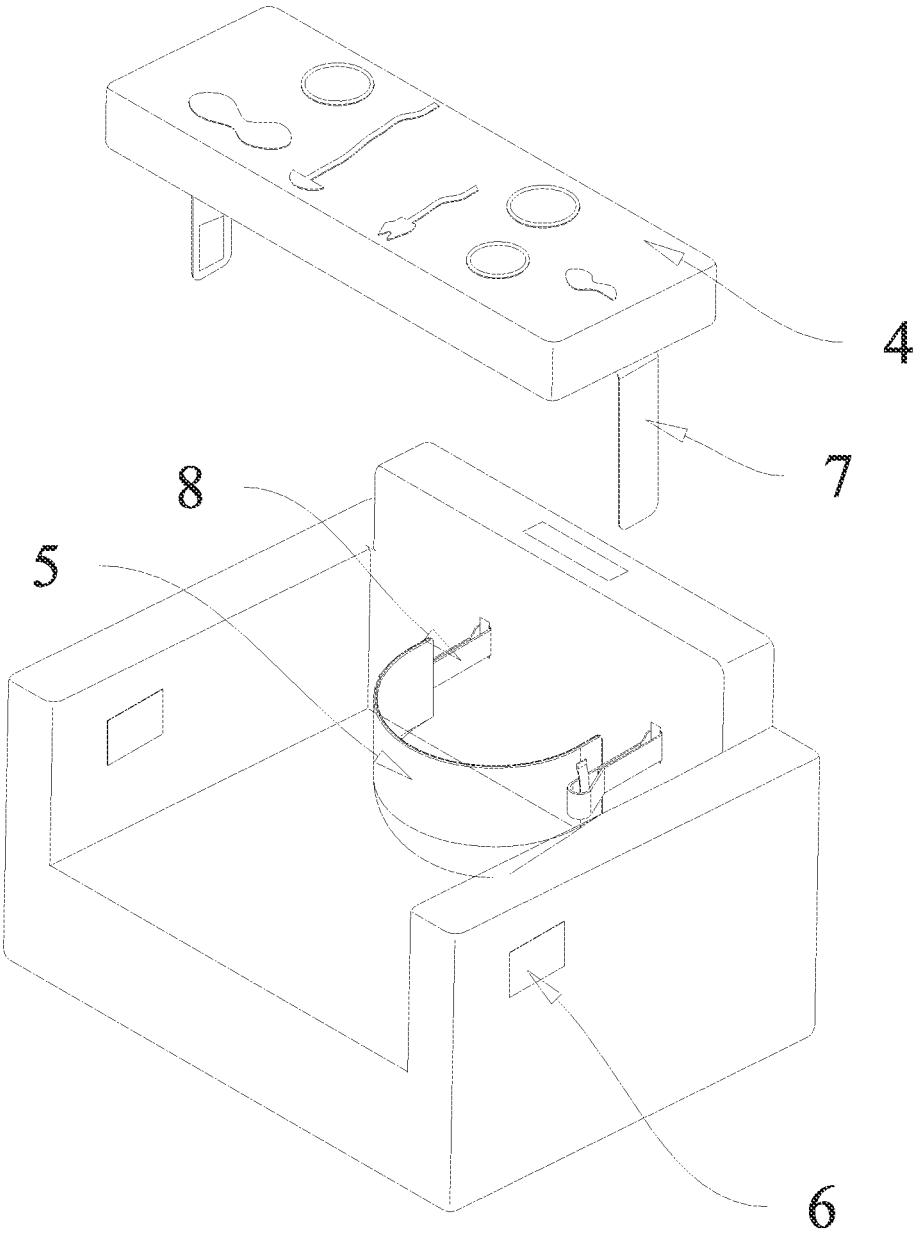
FIG. 2 is a three-dimensional schematic diagram of a table board of the present utility model in a disassembled state.
Figure 3:
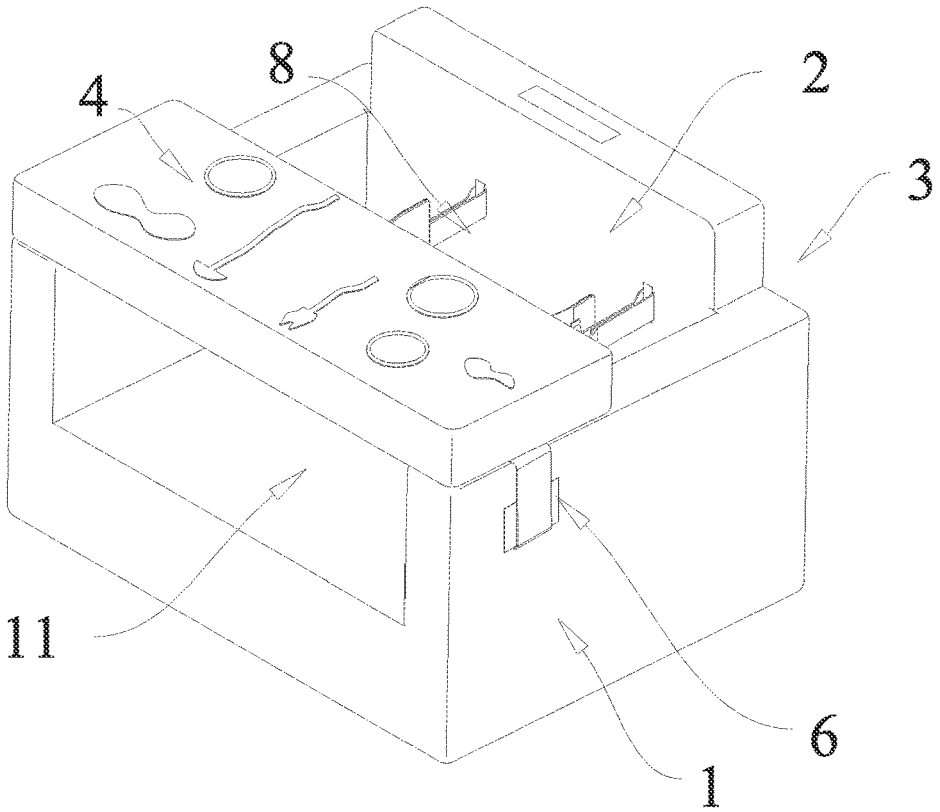
FIG. 3 is a three-dimensional schematic diagram of the present utility model in an assembled state.
Figure 4:
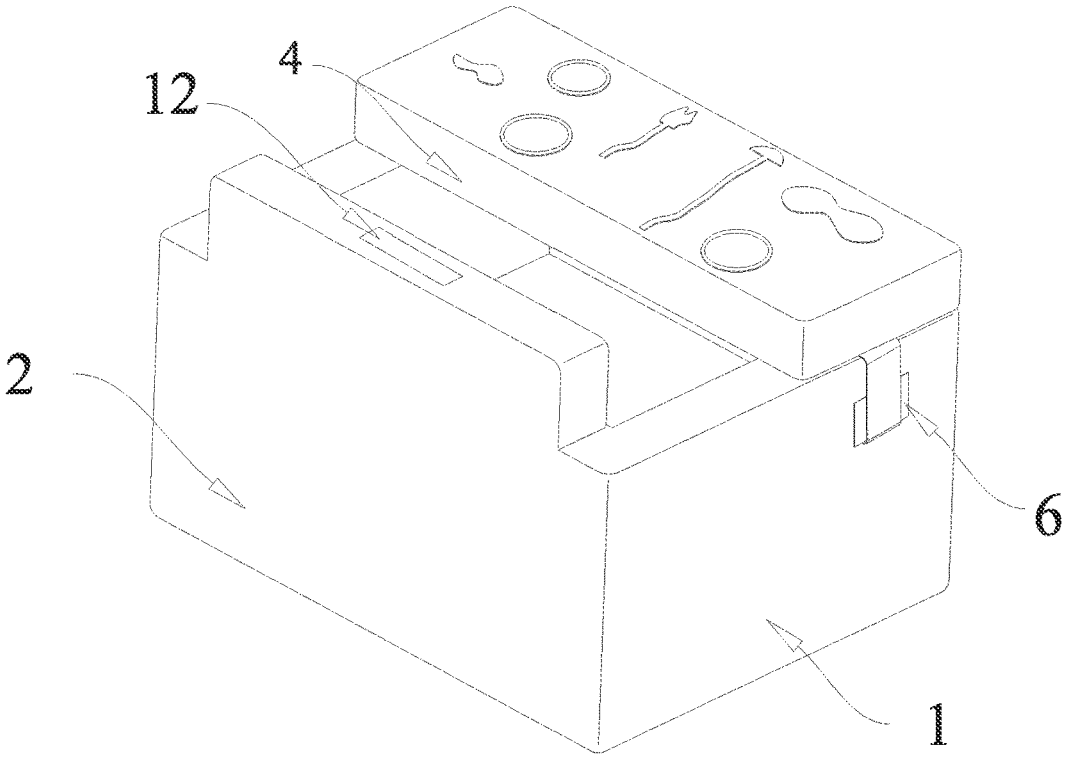
FIG. 4 is a structural representation of a cloth handle.

As shown in FIGS. 1 to 4, the present utility model provides a game table and chair for babies. The game table and chair for babies comprises a seat 3 with armrests 1 and a backrest 2, wherein the front sides of the armrests 1 are detachably connected with a table board 4; through grooves 11 allowing feet of a baby to pass through are formed between the table board 4 and a bottom plate of the seat 3 and between the armrests 1 on the two sides, and the through grooves 11 are communicated with the outside; the feet of a baby pass through the through grooves 11 to hang on the side wall of the front side of the seat 3 for movement so that moving space of a baby is increased, and experience and interaction of games are enhanced; and crotch cloth 5 is arranged on the backrest 2 of the seat 3, the seat 3 and the table board 4 are made by soft cushions, and inner cores of the soft cushions can be made by soft materials like pearl wool and PP (polypropylene) wool, so the game table and chair for babies is safe and comfortable.

The outer side face of each armrest 1 is a plane, a table top mounting belt 6 is arranged on the outer side face of each armrest 1, the two sides of each table top mounting belt 6 are connected with the corresponding armrest 1, and a first mounting hole is formed between the middle of each table top mounting belt 6 and the corresponding armrest 1; the table top mounting belts 6 are arranged on the armrests 1 on the two sides of the seat 3; table top mounting strips 7 are correspondingly connected to the two sides of the table board 4; the end and the belt body of each table top mounting strip 7 are provided with a magic tape and a magic tape fastener respectively; and the table top mounting strips 7 penetrate through the first mounting holes, the table top mounting strips 7 and the seat 3 are detachably connected together through the magic tapes and the magic tape fasteners, and therefore, the mounting is convenient, and a stable game table top is provided.

After the table board 4 is detached, a baby can freely practice how to get on or off the chair on the seat 3, the baby can learn to sit and stand conveniently, and multiple baby toys can be placed on the table board 4.

The leaning face of the backrest 2 is a rectangular plane, and the armrests 1 are arranged on the two sides of the backrest 2 and are straight armrests; the whole game table and chair for babies is in a semi-closed square shape; the through grooves 11 are formed to be communicated with the outside, and therefore the activity space of the baby in the seat can be increased; and the game table and chair for baby are suitable for lively and active babies with certain activity ability and older ages.

Two backrest mounting belts 9 are arranged on the front face of the backrest 2, the two sides of the backrest mounting belts 9 are connected with the backrest 2, and a second mounting hole is formed between the middle of each backrest mounting belt 9 and the backrest 2; the second mounting holes are selectively connected with a crotch cloth 5, a safety belt or other protection devices, and the baby of a larger age can be prevented from crossing the seat and falling down. Two waistbands 8 are arranged on the crotch cloth 5, the crotch cloth 5 is made of cotton cloth and is in an inverted triangle shape, magic tapes and magic tape fasteners are arranged at the ends and the waistband bodies of the waistbands 8 on the crotch cloth 5 respectively; the waistbands 8 penetrate through the second mounting holes of the backrest mounting belts 9, and the waistbands 8 and the seat 3 are detachably connected together through the magic tapes and the magic tape fasteners. The two legs of the baby are placed in a cavity formed between the triangular crotch cloth 5 and the waistbands 8, the correct sitting posture of the baby is guaranteed by arranging the crotch cloth 5, and therefore the spine, not completely developed, of the baby is protected.

A handle 12 is arranged on the upper surface of the backrest 2 of the seat, and carrying is convenient. The handle 12, the table top mounting belts 6, the table top mounting strips 7, the backrest mounting belts 9 and the waistbands 8 are all made of cotton cloth, and materials are saved.

The above embodiment is only a preferred technical solution of the present utility model. It should be appreciated for those skilled in the art that modifications or substitutions of the technical solutions or parameters in the embodiments can be made without departing from the principle and essence of the present utility model, and all these modifications or substitutions shall fall within the protection scope of the present utility model.

The invention claimed is:

1. A game table and chair for babies, comprising a semi-closed seat with armrests and a backrest, wherein the front sides of the armrests are detachably connected with a table board; the outer side faces of the armrests are planes, and table top mounting belts are arranged on the outer side faces; the two sides of the table top mounting belts are connected with the armrests, and first mounting holes are formed between the middles of the table top mounting belts and the armrests; the side face of the table board is correspondingly connected with table top mounting strips; magic tapes and magic tape fasteners are arranged at the ends and belt bodies of the table top mounting strips respectively; the table top mounting strips penetrate through the first mounting holes, and the table top mounting strips and the seat are detachably connected together through the magic tapes and the magic tape fasteners; two backrest mounting belts are arranged on the front face of the backrest; the two sides of the backrest mounting belts are connected with the backrest; and second mounting holes are formed between the middles of the backrest mounting belts and the backrest.

2. The game table and chair for babies according to claim 1, wherein the leaning face of the backrest is a rectangular plane, the armrests are arranged on the two sides of the backrest and are straight armrests, and the whole game table and chair for baby is in a semi-closed square shape.

3. The game table and chair for babies according to claim 1, wherein through grooves allowing feet of the baby to penetrate through are formed between the table board and a bottom plate of the seat and between the armrests on the two sides, and the through grooves are communicated with the outside.

4. The game table and chair for babies according to claim 1, wherein a handle is arranged on the upper surface of the backrest of the seat.

5. The game table and chair for babies according to claim 1, wherein the table top mounting belts are arranged on the armrests on the two sides of the seat, and the table top mounting strips are correspondingly connected to the two sides of the table board.

* * * * *